United States Patent [19]

Lambert et al.

[11] Patent Number: 4,486,243

[45] Date of Patent: Dec. 4, 1984

[54] METHOD OF MANUFACTURING RAILS

[75] Inventors: Nicole Lambert, Waremme; Pierre Simon, Montegnée; René Conti, Athus, all of Belgium

[73] Assignees: Centre de Recherches Metallurgiques-Centrum Voor Research In de Metallurgie, Brussels, Belgium; Metallurgique & Miniere de Rodange-Athus, SA., Rodange, Luxembourg

[21] Appl. No.: 540,523

[22] Filed: Oct. 11, 1983

[30] Foreign Application Priority Data

Oct. 11, 1982 [LU] Luxembourg ..... 84417

[51] Int. Cl.[3] ..... C21D 9/04; C21D 9/06

[52] U.S. Cl. ..... 148/12 R; 148/12.4; 148/146; 148/156

[58] Field of Search ..... 148/146, 156, 12.4, 148/12 R

[56] References Cited

U.S. PATENT DOCUMENTS 2,882,191 4/1959 Van Swaal ..... 148/146

3,497,403 2/1970 Rutherford et al. ..... 148/146

*Primary Examiner*—W. Stallard

*Attorney, Agent, or Firm*—Holman & Stern

[57] ABSTRACT

At the outlet of a hot rolling mill the temperature of a hot rolled rail is reduced to a value not lower than that at which the pearlitic transformation begins in the rail head. The continuously moving rail is then rapidly cooled to below 650° C. so that at least 80% of the austenite-pearlite transformation has occurred at the end of rapid cooling. The rail is then cooled to ambient temperature.

8 Claims, No Drawings

METHOD OF MANUFACTURING RAILS

The invention relates to an improved method of manufacturing rails, inter alia high-strength rails.

Its aim is to obtain rails at the rolling heat, preferably without adding alloy elements, such that the rails have the following mechanical characteristics after cooling:

High rupture strength—at least 1080 MPa in the rail head for high-strength steel and Elongation—at least equal to 10%.

The term "high-strength steel" refers particularly to steel containing 0.4% to 0.85% C, 0.4% to 1% Mn, and 0.1 to 0.4% Si, and preferably 0.6 to 0.85% C and 0.6% to 0.8% Mn.

If required, the steel can contain up to 1% Cr or up to 0.3% Mo or up to 0.15% V.

Without departing from the invention, the method can be applied to steel having a carbon and manganese content between 0.4% and 0.6% and preferably not containing alloy elements and having a rupture strength of at least 750 MPa.

It is well known for rolled products, on leaving the hot rolling mill, to be given relatively accelerated cooling by immersing them in a tank containing a water bath which may be at boiling-point.

In this connection, a method of treating a rail in boiling water is already known from Belgian PS No. 754 416. However, the known process produces very steep thermal gradients between the head and the flange during treatment, resulting in considerable permanent deformation of the rail.

To obviate this disadvantage it was proposed, more particularly in Belgian PS No. 854 834, to cool the rail differentially by cooling the head in different manner from the flange. According to the last-mentioned patent, the rail head is given accelerated cooling by immersion in mechanically-agitated boiling water, whereas the flange is cooled in air or in still water at 100° C.

The known method admittedly reduces permanent deformation in rails, but presents great technological difficulties when worked on an industrial scale. It may also cause considerable temporary deformation of the rail during processing, with the risk of producing some permanent deformation.

The invention relates to a method of eliminating the aforementioned disadvantages.

The method according to the invention is characterised in that at the outlet of the hot rolling mill the rail temperature is reduced to a value not lower than the temperature at which the pearlitic transformation begins in the rail head; after reaching this temperature, the rail is continuously moved and rapidly cooled to a temperature below about 650° C. so that at least 80% of the allotropic austenite-pearlite transformation has occurred in the rail at the end of rapid cooling, and the rail is then cooled to ambient temperature.

According to a first advantageous variant of the method, the rate of rapid cooling is between 2° C./s and 10° C./s.

The method is advantageously applied by adjusting the heat transfer coefficient between the rail and the cooling agent during rapid cooling.

According to an advantageous embodiment, rapid cooling is brought about by spraying water on to the rail and adapting the flow rate of sprayed water to the rail temperature.

According to another feature, the flow rate of water sprayed during rapid cooling is adapted to the size of the various parts of the rail, so as to obtain a substantially identical rate of cooling in all parts of the rail.

In a particularly advantageous embodiment, the rail is rapidly cooled by using a device comprising water-spraying means, e.g. nozzles, distributed around the rail and along its trajectory, so as to adjust the flow rate of sprayed water to the rail temperature.

In this connection, it is particularly advantageous for the nozzles to be non-uniformly distributed along the rail trajectory, inter alia by increasing the number of nozzles in the region where recalescence occurs in the steel.

According to another variant of the method, the rail is accelerated, preferably in substantially uniform manner, in the rapid cooling region and the amount of acceleration is adjusted to the measured temperature difference between the ends of the rail at the cooling region inlet, so that the rail temperature at the outlet thereof is less than about 650° C. and at least 80% of the allotropic austenite-pearlite transformation has occurred in the rail at the aforementioned outlet.

According to the invention, the acceleration enables the rail temperature to be kept substantially constant at the outlet of the rapid cooling region and ensures that recalescence at any portion of the rail always occurs at the appropriate part of the rapid cooling region.

The method according to the invention can limit the effects of recalescence and of differences in the size of the various parts of the rail (head, web, flange) on temporary deformation during cooling.

Besides giving good desired mechanical properties, the process improves the straightness of the rails by greatly reducing temporary deformation during cooling and consequently reducing the amount of straightening after rolling.

The following example illustrates the considerable improvement made by the method according to the invention.

Three rails (A, B, C) 12 m in length were cooled (1) by a known process of immersion in boiling water, (2) by the process according to the invention without acceleration and (3) with acceleration of the rail during rapid cooling. The three rails were made of steel having substantially the same composition:

C: 0.75–0.80%

Mn: 0.60–0.70%

Si: 0.20–0.25%

In all three cases, the 12 m rails coming from the rolling mill left the sawing station at a temperature of about 950° C. The mechanical properties of the head were determined to UIC Standard 860.0, i.e. at 2/5 rhs of the height of the head.

Rail A was cooled in air to 695° C. and then immersed in boiling water for 67 seconds. Its temperature on leaving the water was 560° C.

The rail head had a rupture load of 1115 MPa and an elongation of 10%. On leaving the bath, rail A had a vertical sag of 700 mm, which disappeared after 300 sec. Thus, although straightened during final cooling, the rail had considerable temporary deformation.

Rail B was cooled while moving at a uniform speed of 0.16 m/s, by spraying water at a rate of 28 $m^3/h$. The length of the rapid cooling region was 10.70 m, i.e. the duration of cooling was 67 sec. The temperature at the inlet to the cooling region was about 800° C. and the temperature at the outlet was 630° C.

After this treatment, the head had a rupture load of 1188 MPa and an elongation of 10%. It was impossible to measure the sag of the rail in the rapid cooling region, since the rail came out of the guide. The permanent vertical sag after complete cooling was 60 mm.

Rail C was treated in the same manner as rail B but with an initial speed of 0.18 m/s and an acceleration of the order of 0.01 m/sec$^2$, so that the duration of treatment was reduced to 46 sec. The flow rate of cooling water was 34.2 m$^3$/h.

The rail temperature was 800° C. at the inlet and 620° C. at the outlet of the cooling region.

Under these conditions, the head had a rupture load of 1100 MPa and an elongation of 12.5%.

The maximum vertical sag during cooling was 20 mm and the permanent vertical sag after final cooling was likewise about 20 mm.

These values confirm the improvement made by the invention to the transitory deformation of rails.

We claim:

1. A method of manufacturing rails, comprising the sequential steps of hot rolling a rail in a hot rolling mill; at the outlet of the hot rolling mill, reducing the rail temperature to a value not lower than the temperature at which the pearlitic transformation begins in the rail head; after reaching this temperature, continuously moving the rail and rapidly cooling it to a temperature below about 650° C. so that at least 80% of the allotropic austenite-pearlite transformation has occurred in the rail at the end of rapid cooling; and then cooling the rail to ambient temperature.

2. A method as claimed in claim 1, in which the rate of rapid cooling is between 2° C./s and 10° C./s.

3. A method as claimed in claim 1, including adjusting the heat transfer coefficient between the rail and the cooling agent during rapid cooling.

4. A method as claimed in claim 1, in which the rail is rapidly cooled by spraying a cooling agent such as water or a water mist.

5. A method as claimed in claim 4, in which the flow rate of cooling agent is adjusted to the rail temperature and/or the size of the various parts of the rail.

6. A method as claimed in claim 1, in which the rail is rapidly cooled by using an installation comprising means for spraying a cooling agent, the said means being distributed around the rail and/or along its trajectory, so that the flow rate of sprayed cooling agent can be adjusted to the rail temperature.

7. A method as claimed in claim 1, including accelerating the rail preferably substantially uniformly, in the rapid cooling region, the amount of acceleration being adjusted to the measured temperature difference between the ends of the rail at the cooling region inlet, so that the rail temperature at the outlet thereof is less than about 650° C. and at least 80% of the allotropic austenite-pearlite transformation has occurred in the rail at the said outlet.

8. A method as claimed in claim 1, in which the flow rate of cooling agent is increased in that portion of the rapid cooling region where recalescence occurs in the steel of the rail.

* * * * *